US008577272B2

(12) United States Patent
Matsubara et al.

(10) Patent No.: US 8,577,272 B2
(45) Date of Patent: Nov. 5, 2013

(54) FIXING DEVICE AND IMAGE FORMING APPARATUS HAVING A SLANTINGLY EXTENDED IRRADIATION AREA

(75) Inventors: Takashi Matsubara, Kanagawa (JP); Makoto Furuki, Kanagawa (JP); Naoyuki Egusa, Kanagawa (JP); Tetsuro Kodera, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 339 days.

(21) Appl. No.: 13/006,033

(22) Filed: Jan. 13, 2011

(65) Prior Publication Data

US 2012/0076557 A1 Mar. 29, 2012

(30) Foreign Application Priority Data

Sep. 24, 2010 (JP) ..... 2010-213782

(51) Int. Cl.
*G03G 15/20* (2006.01)

(52) U.S. Cl.
USPC ..... 399/336

(58) Field of Classification Search
USPC ..... 399/336, 335, 320; 219/216
See application file for complete search history.

(56) References Cited

U.S. PATENT DOCUMENTS 4,693,587 A * 9/1987 Shigenobu et al. ..... 399/339
5,436,710 A 7/1995 Uchiyama

FOREIGN PATENT DOCUMENTS

JP 55050282 A * 4/1980
JP 59095568 A * 6/1984
JP 59128569 A * 7/1984
JP A-6-301304 10/1994
JP A-7-191560 7/1995

* cited by examiner

*Primary Examiner* — Billy J Lactaoen
(74) *Attorney, Agent, or Firm* — Oliff & Berridge, PLC

(57) ABSTRACT

A fixing device includes: a conveying unit that conveys a recording material with an image formed thereon toward a predetermined conveying direction so as to cross a fixing area where the image is heated to be fixed; a laser light source that has an irradiation area as the fixing area slantingly extending relative to a predetermined image arrangement reference direction along a width direction of the recording material crossing the conveying direction of the recording material, and irradiates the irradiation area with laser light; and a reflecting member that is provided so as to surround the irradiation area and has a reflecting face that reflects reflected light from the irradiation area so that the irradiation area is again irradiated with the reflected light.

21 Claims, 18 Drawing Sheets

FIXING DEVICE AND IMAGE FORMING APPARATUS HAVING A SLANTINGLY EXTENDED IRRADIATION AREA

CROSS-REFERENCE TO RELATED APPLICATIONS

This application is based on and claims priority under 35 USC 119 from Japanese Patent Application No. 2010-213782 filed on Sep. 24, 2010.

BACKGROUND

Technical Field

This invention relates to a fixing device and an image forming apparatus including the fixing device.

SUMMARY

According to an aspect of the invention, there is provided a fixing device including: a conveying unit that conveys a recording material with an image formed thereon toward a predetermined conveying direction so as to cross a fixing area where the image is heated to be fixed; a laser light source that has an irradiation area as the fixing area slantingly extending relative to a predetermined image arrangement reference direction along a width direction of the recording material crossing the conveying direction of the recording material, and irradiates the irradiation area with laser light; and a reflecting member that is provided so as to surround the irradiation area and has a reflecting face that reflects reflected light from the irradiation area so that the irradiation area is again irradiated with the reflected light.

BRIEF DESCRIPTION OF THE DRAWINGS

Exemplary embodiments of the present invention will be described in detail based on the following figures, wherein:

FIG. 1A is a perspective view and FIG. 1B is a drawing seen from B direction of FIG. 1A;

DETAILED DESCRIPTION

Summary of Exemplary Embodiments of the Invention

First, a summary of an embodiment of a fixing device incorporating the invention will be discussed.

Figure 1A:
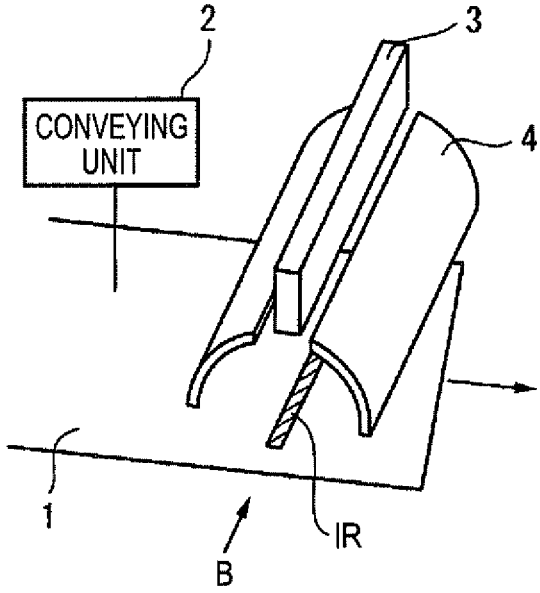
FIGS. 1A and 1B are schematic representations to show a fixing device according to an embodiment of the invention.
Figure 1B:
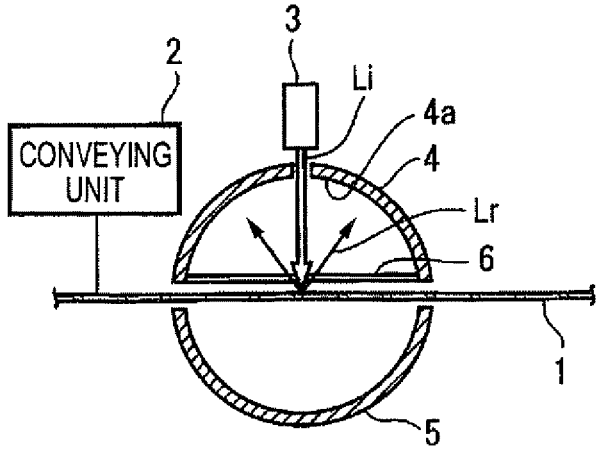
Figure 18:
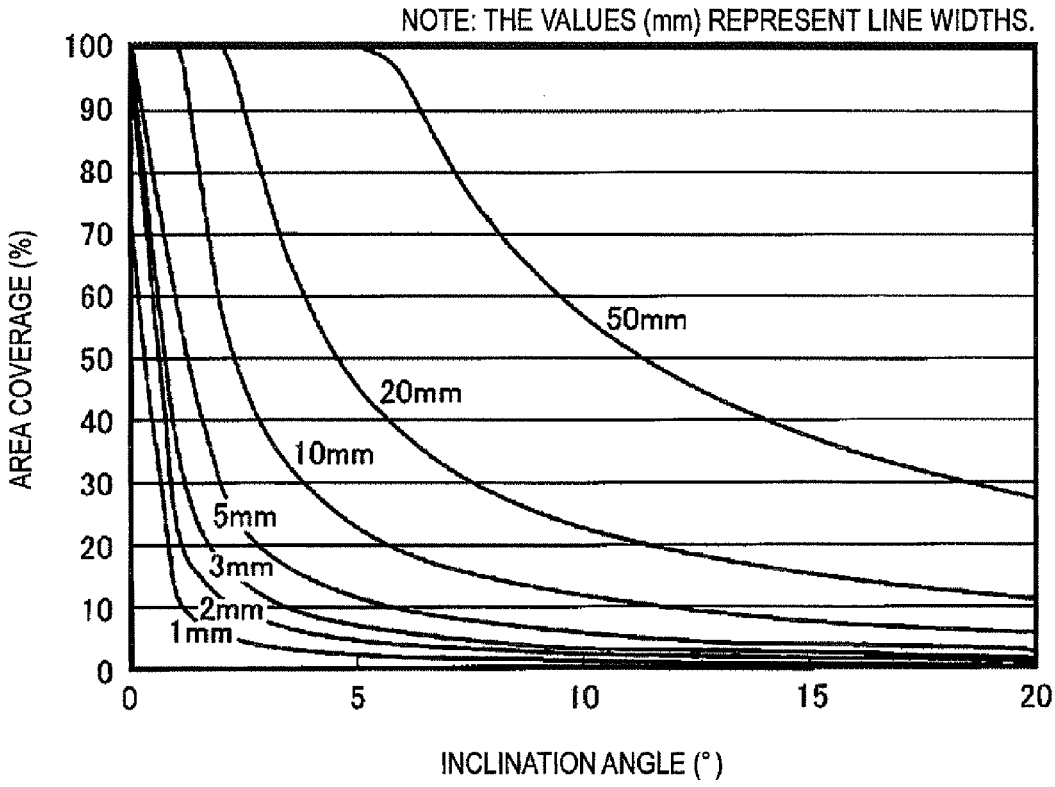
FIG. 18 is a graph to show the result of Embodiment 2.

FIGS. 1A and 18 are schematic representations to show a fixing device according to an embodiment of the invention; FIG. 1A is a perspective view and FIG. 1B is a drawing seen from B direction of FIG. 1A.

The fixing device includes a conveying unit 2 for conveying a recording material 1 with an image formed thereon toward a predetermined conveying direction so as to cross a fixing area where an image can be heated and fixed, a laser light source 3 having an irradiation area IR as a fixing area slantingly extending relative to a predetermined image arrangement reference direction along the width direction of the recording material 1 crossing the conveying direction of the recording material 1, the laser light source 3 for irradiating the irradiation area IR with laser light Li, and a reflecting member 4 provided so as to surround the narrow width direction of the irradiation area IR and having a reflecting face 4*a* for reflecting reflected light Lr so that the irradiation area IR is again irradiated with the reflected light Lr from the irradiation area IR by the laser light Li applied from the laser light source 3.

As a representative material for forming an image on the recording material 1, toner used with electrophotography can be named, but the material is not limited to the toner; for example, ink of heat and fusion type used with an ink jet system, etc., may be adopted.

As the recording material 1, representatively, continuous forms paper (roll paper), a cut sheet of paper can be named, but a film medium other than the paper medium may be adopted.

Further, the expression "predetermined image arrangement reference direction along the width direction of the recording material 1 is used to mean that an image is mainly arranged along the width direction of the recording material 1, and also contains a ruled line, etc.

As a representative form of the laser light source 3, array laser type wherein a plurality of light emission parts of the laser light Li are provided in a row along the extending direction of the irradiation area IR.

Preferably, the irradiation area IR is provided linearly along the direction crossing the recording material 1, but may be shaped like separated lines or a mountain. Further, the reflected light Lr from the irradiation area IR also contains scattered light.

Light reflected by the reflecting member 4 and again applied to the irradiation area IR may be again applied to a part containing the irradiation area IR and is not limited the irradiation area. For the reflecting member, the reflecting face 4*a* may be, for example, a bent mirror face, a retroreflective face, or a diffusing surface. Further, the reflecting member 4 may be of an integral structure or may be of a split structure. For example, for the split structure, at least either the upstream side or the downstream side in the conveying direction of the recording material 1 from the laser light source 3 may be further split; the reflecting member may have a structure capable of again irradiating the irradiation area with the reflected light Lr from the irradiation area IR.

The back of the recording material 1 may be provided with an opposed member placed so as to hold the recording material 1 toward the laser light source 3 and transmitted light of the laser light Li passing through the recording material 1 may be reflected on the opposed member (flat or curved surface member) or another bent reflecting member (back side reflecting member 5 described later) may be provided at a distant position from the recording material 1. Alternatively, nothing may be provided.

Next, the function in the irradiation area IR in the embodiment will be discussed.

Figure 2:
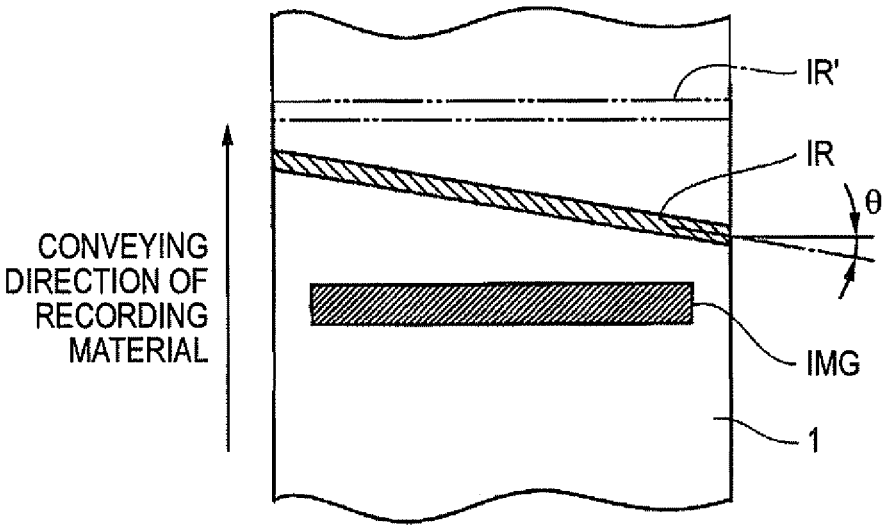
FIG. 2 is a schematic representation to show the relationship between an image and an irradiation area.

FIG. 2 is a drawing to show the relationship between an image IMG (an image with image density 100% is assumed) formed linearly along the width direction of the recording material 1 crossing the conveying direction of the recording material 1 as an image and the irradiation area IR and to compare with an irradiation area IR' of a general irradiation area. In this case, the irradiation area IR in the example is inclined by inclination angle θ from the width direction of the recording material 1; while, the irradiation area IR' in a comparison example is provided along the width direction of the recording material 1. It is assumed that the width of the image IMG (length along the conveying direction of the recording material 1) is larger than the width of the irradiation area IR, IR'.

Figure 3:
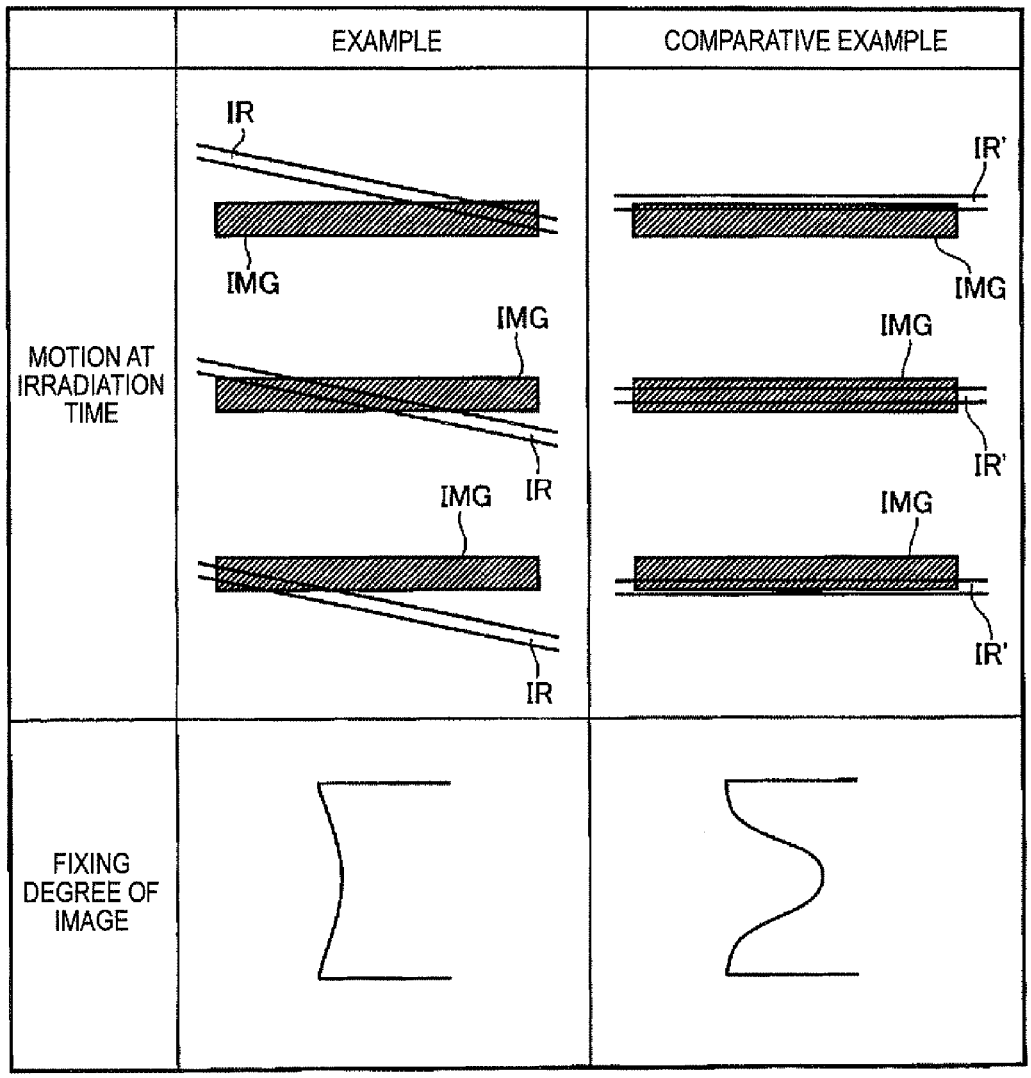
FIG. 3 is a schematic representation to show a state when a thick line image is fixed to the irradiation area.

When the recording material 1 is conveyed in such a state, motion of the image IMG relative to the irradiation area IR at the irradiation time and the fixing degree of the image IMG become as shown in FIG. 3.

In the drawing, in the example, since the irradiation area IR is inclined relative to the image IMG, a portion where the image IMG does not exist in the surrounding of the image IMG passing through the irradiation area IR and the image IMG is again irradiated with the reflected light Lr from the portion, whereby fixing of the image IMG is promoted.

On the other hand, in the comparison example, at the stage at which the image IMG is applied to the irradiation area IR', the image IMG is again irradiated with the reflected light Lr from the portion where the image IMG does not exist, whereby fixing of the image IMG is promoted. However, the reflected light Lr is not used at the stage at which the image IMG covers the irradiation area IR', and fixing of the image IMG remains in an insufficient state. When the trailing end of the image IMG enters the irradiation area IR', the image is again irradiated with the reflected light Lr, whereby fixing of the image IMG is promoted.

Thus, in the fixing degree in the conveying direction of the recording material 1 of the image IMG (corresponding to the width direction of the image IMG), in the example, insufficiency of fixing of the center portion relative to the width direction of the image IMG is minimized; whereas, in the comparison example, fixing of the center portion relative to the width direction of the image IMG becomes insufficient. Therefore, as compared with the example, it is necessary to enlarge laser output at the fixing time in the comparison example.

Generally, as an image on the recording material 1, an image along the width direction of the recording material 1 is often adopted. It becomes noticeable, for example, when a thick ruled line is used, particularly when a Gothic thick character is used, etc. Therefore, the irradiation area IR of the laser light Li is inclined relative to the width direction of the recording material 1, whereby it is made possible to fix an image stably with small power consumption.

As shown in FIG. 2, if the inclination angle θ of the irradiation area IR is made large to some extent, the use efficiency of the reflected light Lr when the image IMG is fixed increases. However, if the inclination angle θ is made large, the length of the irradiation area IR astride the recording material 1 becomes long. For example, in the array laser type wherein a plurality of high-output semiconductor lasers are used as the laser light source 3, there are disadvantages of the cost and power consumption as the number of semiconductor lasers increases. Therefore, preferably the inclination angle θ is set in a small range to some extent.

As shown in FIG. 1B, from the viewpoint of effective use of transmitted light of the laser light Li applied to the recording material 1, in the form wherein an opposed member coming in contact with the back of the recording material 1 is not included, preferably the fixing device further includes the back side reflecting member 5 provided in a part opposed to the reflecting member across the recording material 1 for reflecting the transmitted light so that the transmitted light applied from the laser light source 3 and passing through the recording material 1 is again applied to the back part of the recording material 1 corresponding to the irradiation area IR.

Further, from the viewpoint of adopting a simple configuration as the reflecting member 4, preferably the reflecting face 4*a* of the reflecting member 4 opposed to the recording material 1 has a cylindrically curved surface. The shape on a different side from the reflecting face 4*a* of the reflecting member 4 is not limited, but preferably the shape is a shape similar to the reflecting face 4*a* from the viewpoint of more simplifying the configuration of the reflecting member 4. Further, preferably the back side reflecting member 5 is of a similar shape to that of the reflecting member 4 and has a cylindrically curved surface relative to the back part corresponding to the irradiation area IR.

From the viewpoint of effectively accomplishing the reflecting performance on the reflecting member 4, preferably the laser light source 3 is placed at a position where the laser light Li is applied to the irradiation area IR from an inclined position along the cylindrically curved surface of the reflecting member 4 from the direction orthogonal to the recording material 1 face in the irradiation area IR. Accordingly, the reflecting member 4 in a part again irradiating the irradiation area IR with the reflected light Lr of the laser light Li applied from the laser light source 3 is ensured largely and stable re-irradiation is performed.

Further, from the viewpoint of ensuring the reflecting performance on the reflecting member over a long term, preferably the fixing device includes a protection member 6 for allowing the laser light Li to pass through and preventing an evaporated substance evaporated from the image on the recording material 1 from being deposited on the reflecting face 4*a* of the reflecting member 4. The protection member 6 may be provided directly on the reflection member 4 or may be provided separately from the reflection member 4. An evaporated substance from the recording material 1 is also contained in addition to the evaporated substance from the image.

From the viewpoint of performing fixing more fitted to the image on the recording material 1, preferably the fixing device includes a determination unit for determining whether or not the image density along the extending direction of the irradiation area exceeds a predetermined criterion value from image information of a predetermined image length in the conveying direction of the recording material 1 and an irradiation area changing unit, if the image density exceeds the criterion value based on the determination result of the determination unit, the means for finding an extending direction of a new irradiation area IR wherein the image density in an inclined direction relative to the width direction of the recording material 1 and a different direction from the extending direction of the irradiation area IR does not exceed the criterion value and changing the irradiation area so that the irradiation area IR becomes the new irradiation area.

That is, if the image density in the direction along the initially setup irradiation area IR becomes higher than the criterion value, the inclination angle θ is changed and the image density in the direction along the new irradiation area IR whose inclination angle θ is changed is prevented from exceeding the criterion value, whereby sufficient fixing performance is ensured without increasing power consumption.

The predetermined image length in the conveying direction of the recording material 1 may be for each image or may be every two or more images. The irradiation area changing unit may move the laser light source 3 and the reflecting member 4 so that the irradiation area is changed and, for example, if the recording material 1 is a cut sheet, the means may change the conveying direction of the recording material 1.

To apply such a fixing device to an image forming apparatus, an image forming section for forming an image on the recording material 1 and a fixing device for fixing an image formed on the image material 1 in the image forming section may be included and the fixing device described above may be used as the fixing device.

In such an image forming apparatus, preferably, the recording material 1 continuous along the conveying direction is used as the recording material 1 to be used.

Next, the invention will be discussed in more detail based on embodiments shown in the accompanying drawings.

Exemplary Embodiment 1

Figure 4:
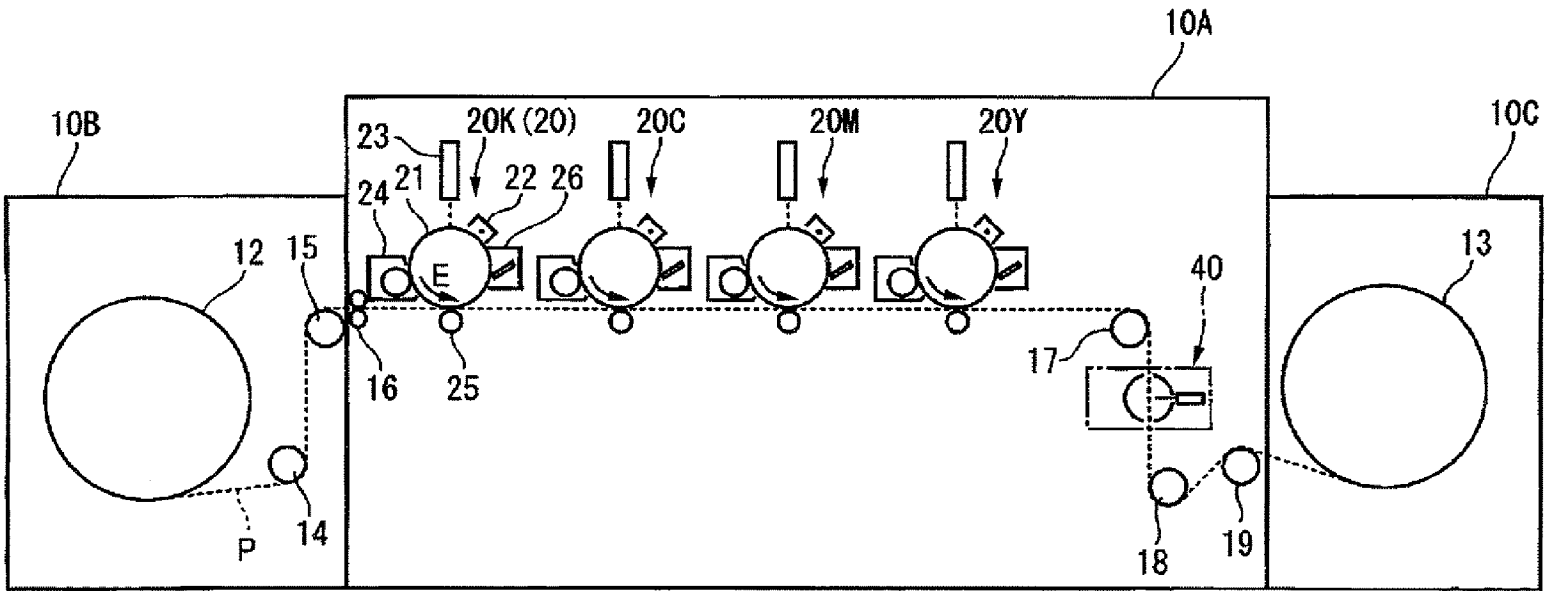
FIG. 4 is a schematic representation to show an outline of the general configuration of an image forming apparatus according to Embodiment 1 of the invention.

FIG. 4 is a schematic representation to show the general configuration of an image forming apparatus according to Embodiment 1 incorporating the fixing device of the embodiment described above.

The image forming apparatus of the embodiment uses a recording material P shaped like continuous forms paper as a recording material and is made up of an image forming main body device 10A for forming an image on the recording material P and a supply device 10B for supplying the recording material P and a storage device for storing the recording material P with an image formed thereon on both sides of the image forming main body device 10A. The recording material P may be shaped like a roll or may be shaped like a fold, for example. In the embodiment, the recording material P is shaped like a roll.

The image forming main body device 10A of the embodiment uses electrophotography, for example, and is made up of color image forming sections 20 for forming toner images of multiple colors using toners of four colors, for example, on the recording material P (specifically, a yellow image forming section 20Y, a magenta image forming section 20M, a cyan image forming section 20C, and a black image forming section 20K), a fixing device 40 for fixing toner images formed in a multiplex state on the recording material P in the color image forming sections 20, and a plurality of roll members 16 to 19 provided as required, and the like.

The roll member 16 is a position adjustment roll for performing position adjustment when the recording material P is introduced to the image forming section 20, the roll member 17 is a stretch roll for introducing the recording material P toward the fixing device 40, and the roll members 18 and 19 are tension giving rolls for giving tension as required when the recording material P with a fixed image is conveyed toward the storage device 10C.

The color image forming sections 20 have each a roughly similar configuration except for used toner and therefore the black image forming section 20K is taken as a representative example in the description. The black image forming section 20K has a cylindrical photoconductive drum 21 having a photoconductive layer (not shown) on a surface and rotating in an arrow E direction. The photoconductive drum 21 is surrounded by a charging device 22 for charging the photoconductive layer of the photoconductive drum 21 to a predetermined potential, an exposure device 23 for selectively irradiating the photoconductive layer charged by the charging device 22 with laser light, for example, to form an electrostatic latent image on the photoconductive drum 21, a developing device 24 for developing the electrostatic latent image formed by the exposure device 23 in toner to form a visible image, a transfer device 25 for transferring the toner image on the photoconductive drum 21 onto the recording material P, a cleaner 26 for cleaning the remaining toner on the photoconductive drum 21 after the transfer, and the like.

The arrangement of the toner colors of the image forming sections 20 is not limited to the arrangement described above and any other arrangement may be used, needless to say.

The supply device 10B is made up of a supply roll 12 for holding the recording material P wound around a core like a roll, tension giving rolls 14 and 15 for giving tension while conveying the recording material P to the image forming main body device 10A for supply, and the like. On the other hand, the storage device 10C is made up of a winding roll 13 for winding the recording material P around a core for storage and the like.

In the image forming apparatus, each color toner image is transferred to the recording material P supplied from the supply device 10B in each color image forming section 20 of the image forming main body device 10A and the toner images are multiplexed on the recording material P. The recording material P to which the unfixed multiplexed toner image is transferred is fixed in the fixing device 40 and then is wound and stored in the storage device 10C.

Next, the fixing device 40 in the image forming apparatus will be discussed based on FIG.

In the figure, the fixing device 40 of the embodiment includes an array laser 41 as a laser light source for irradiating an irradiation area IR extending linearly on the recording material P with laser light Li, a semi-cylindrical reflecting area having a reflecting face provided so as to surround the irradiation area IR for reflecting reflected light so that reflected light from the irradiation area IR by laser light Li applied from the array laser 41 is again applied toward the irradiation area IR, and a semi-cylindrical back side reflecting member 43 opposed to the reflecting member 42 across the recording material P for reflecting transmitted light so that transmitted light applied from the array laser 41 and passing through the recording material P is again applied toward a back side part of the recording material P.

In the embodiment, the fixing device includes a support mechanism 50 for supporting the array laser 41, the reflecting member 42, and the back side reflecting member 43 so that the irradiation area IR is inclined relative to the width direction of the recording material P. That is, in the embodiment, the irradiation area IR is placed in an inclination direction from the width direction of the recording material P (direction indicated by x-x in the figure).

In the example, the array laser 41 uses five high-output semiconductor lasers, but the number of semiconductor lasers, etc., is not limited and any number may be included; however, the array laser needs a length capable of covering the image width in the width direction of the recording material P. The array laser 41 contains an optical system for focusing the laser light Li to the irradiation area IR on the recording material P, for example. The laser light beams Li from the adjacent high-output semiconductor lasers overlap each other in end parts, whereby the irradiation strengths of the laser light beams Li along the extension direction of the irradiation area IR become roughly equal to each other.

The reflecting member 42 is provided with an opening 42*a* of a long hole to allow the irradiation area IR to be irradiated with the laser light Li from the array laser 41 in a roughly central portion of the semi-cylinder.

The support mechanism 50 of the embodiment is made up of a rectangular support body 51 for fixing and supporting the array laser 41, supported piece 52 provided on both sides of the reflecting member 42 along the width direction of the recording material P, a supported piece 53 provided on the back side reflecting member 43, and a subframe 54 for supporting the support body 51 and the two supported pieces 52 and 53. The subframe 54 is provided with fit holes 54*a* to 54*c* into which the support body 51 and the two supported pieces 52 and 53 are fitted. The support body 51 and the two supported pieces 52 and 53 are inserted into the fit holes 54*a* to 54*c* respectively, whereby the array laser 41, the reflecting member 42, and the back side reflecting member 43 are fixed and supported in one body. Only one subframe 54 is shown, but a similar subframe 54 (not shown) is also provided on the opposite side along the width direction of the recording material P, needless to say.

Further, the subframes 54 are fixed to, for example, a main frame (not shown) of the image forming main body device 10A, whereby the irradiation area IR is set in an inclination direction from the width direction of the recording material P. The angle between the width direction of the recording material P (direction indicated by x-x in the figure) and the extension direction of the irradiation area is shown as inclination angle θ in the figure.

Figure 6:
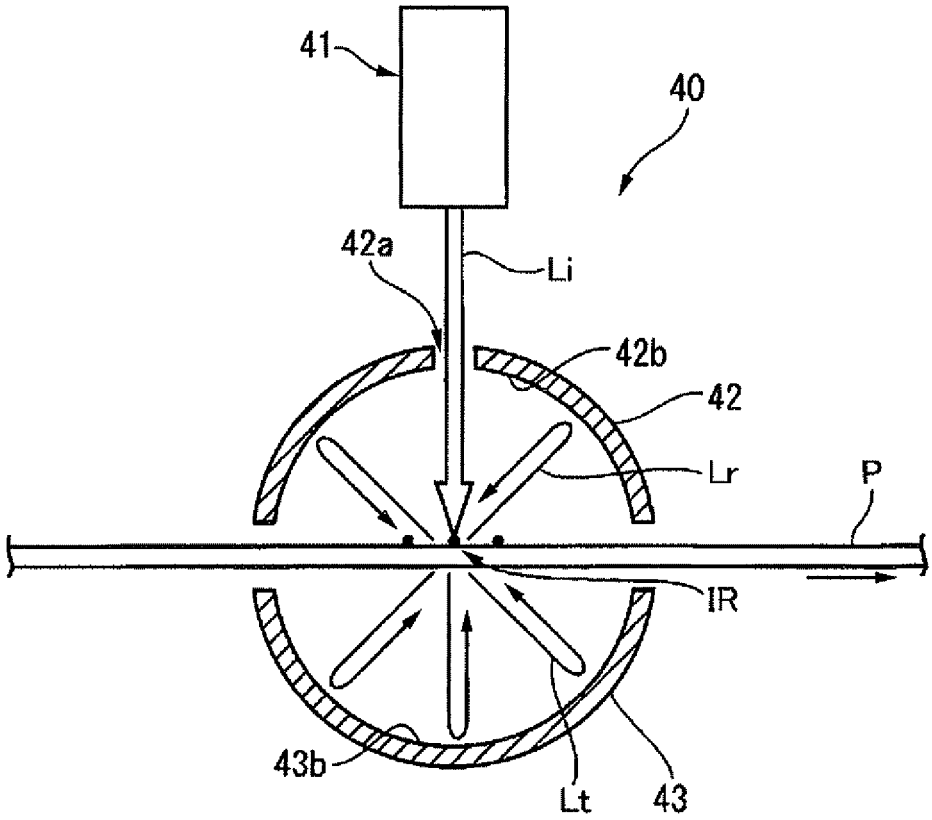
FIG. 6 is a schematic representation when the fixing device of Embodiment 1 of the invention is seen from a cross-sectional direction thereof.

FIG. 6 shows a cross section when the fixing device 40 of the embodiment is seen from a lateral direction. The irradiation area IR is inclined relative to the width direction of the recording material P, needless to say.

In the figure, the laser light Li applied from the array laser 41 proceeds from the opening 42*a* of the reflecting member 42 to the irradiation area IR on the recording material P. The reflected light Lr of the laser light Li applied to the irradiation area from the irradiation area IR is reflected on the reflecting face 42*b* of the reflecting member 42 and is again applied to the irradiation area IR.

On the other hand, transmitted light Lt of the laser light Li passing through the recording material P is again applied to the part corresponding to the irradiation area IR on the back side of the recording material P by the reflecting face 43*b* of the back side reflecting member 43.

Figure 5:
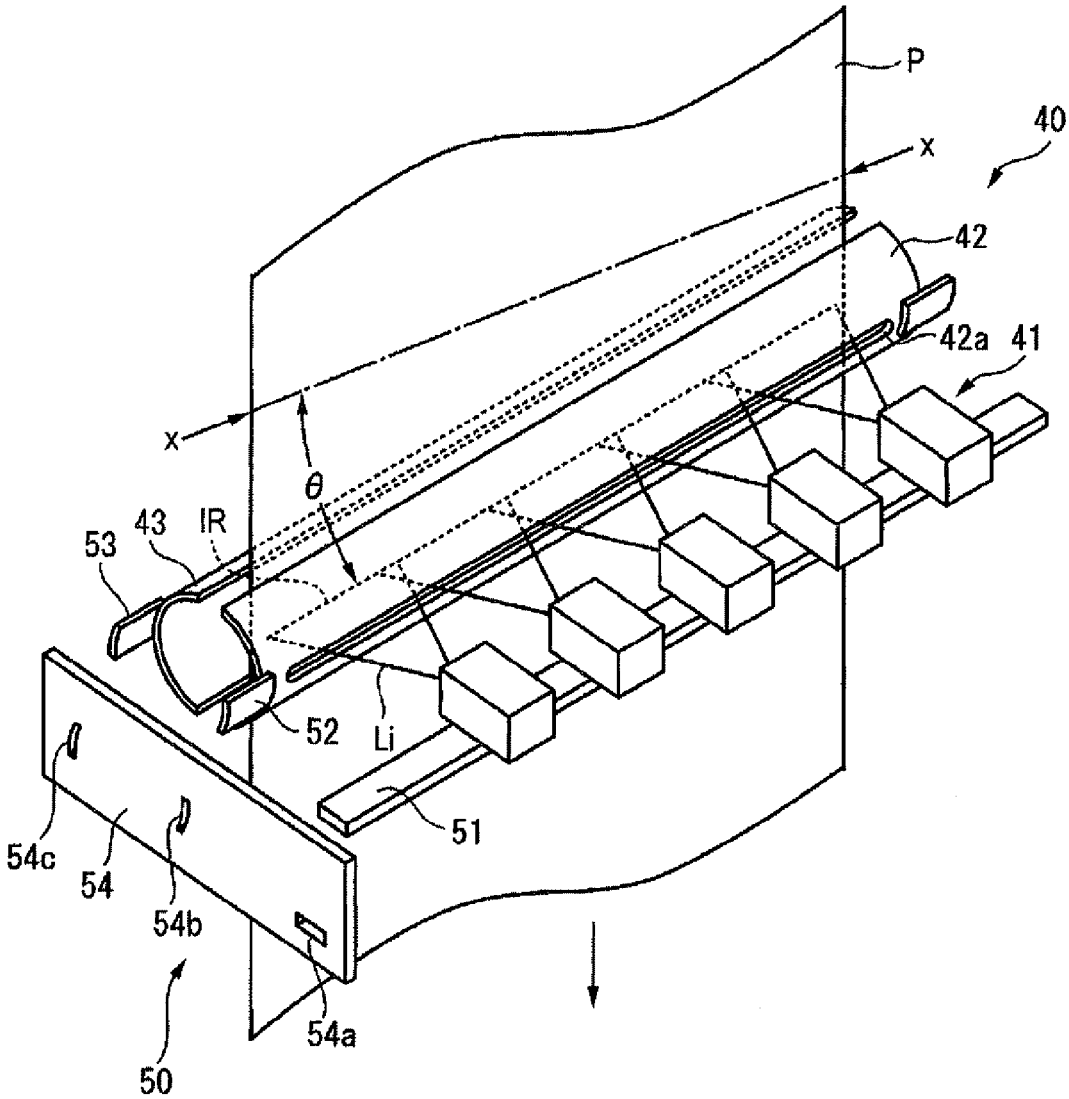
FIG. 5 is a schematic representation to show a fixing device of Embodiment 1 of the invention.

In the embodiment, the irradiation area IR is set in the inclination direction relative to the wide direction of the recording material P, namely, is inclined by the inclination angle θ (see FIG. 5) relative to the width direction of the recording material P. Thus, if a line image (for example, a ruled line, etc.,) along the width direction of the recording material P exists, the image density (area coverage) of an image relative to the irradiation area IR lessens and sufficient reflected light Lr is used.

Therefore, as compared with the case where the irradiation area is provided along the width direction of the recording material P, when the same line image is fixed, laser output is decreased and the image is fixed with low power consumption.

In the embodiment, the back side reflecting member 43 is provided, but no back side reflecting member 43 may be provided. In this case, it becomes necessary to a little increase laser output as compared with the case where the back side reflecting member 43 is provided.

Figure 7:
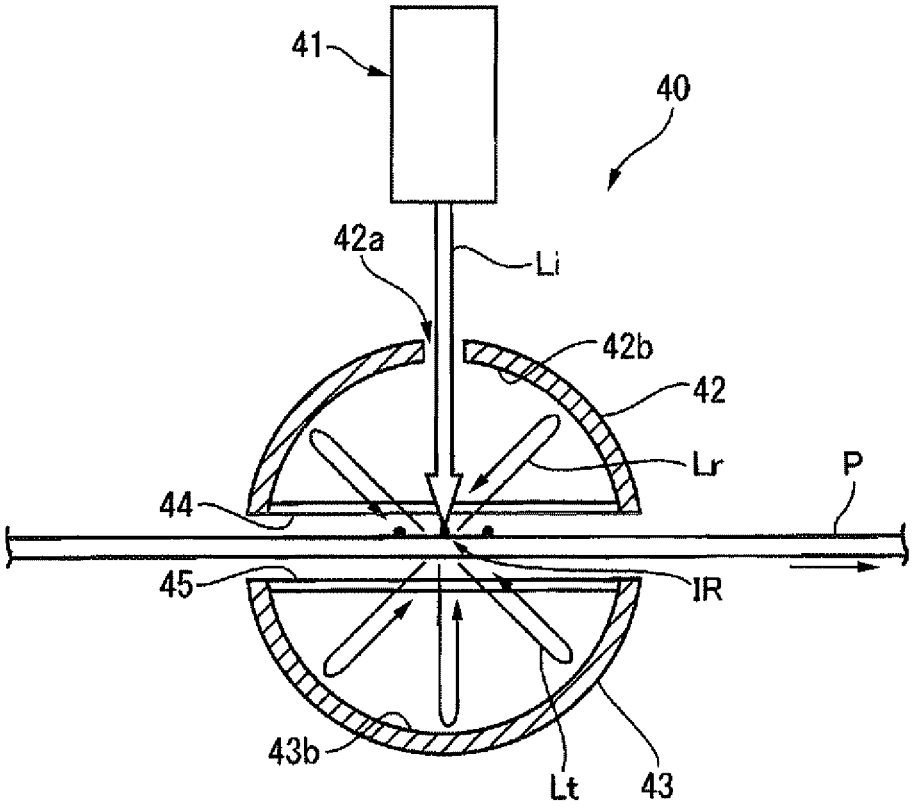
FIG. 7 is a schematic representation to show a fixing device as a first modified example of Embodiment 1 of the invention.

FIG. 7 shows a modified example of the fixing device 40 of the embodiment. Unlike the fixing device in FIG. 6, protection members 44 and 45 provided opposed to the recording material P are attached to the reflection member 42 and the back side reflecting member 43.

The protection members 44 and 45 are formed of a material allowing the laser light Li to pass through. Attenuation for the laser light Li, the reflected light Lr, and the transmitted Lt is small, the light can be effectively used, and heat resistance at the fixing time is also included.

Usually, in a system wherein toner on the recording material is heated and fused for fixing an image, when the toner is heated and fused, an additive, etc., of the toner is evaporated and if the evaporated substance is deposited on the reflecting face 42*b* of the reflecting member 42, for example, degradation of the reflection efficiency on the reflecting face 42*b* is incurred. When the recording material is also heated, moisture is evaporated, etc., and the reflection efficiency on the reflecting face 42*b* is still more degraded because of the moisture. Similar comments also apply to the back side reflecting member 43.

In such a case, the protection members 44 and 45 are provided, whereby the reflection efficiency on the reflecting face 42*b* of the reflecting member 42 and that on the reflecting face 43*b* of the back side reflecting member 43 are maintained and the fixing efficiency is maintained in a stable state. The evaporated substance is also deposited on the protection members 44 and 45, but may be cleaned as required; attenuation of the laser light Li caused by deposition of the evaporated substance on the protection members 44 and 45 is very small and the effect is small as compared with a decrease in the reflection efficiency on the reflection faces 42*b* and 43*b*.

Here, the protection members 44 and 45 are provided directly for the reflection member 42 and the back side reflecting member 43, but may be provided separately from the reflection member 42 and the back side reflecting member 43.

Figure 8:
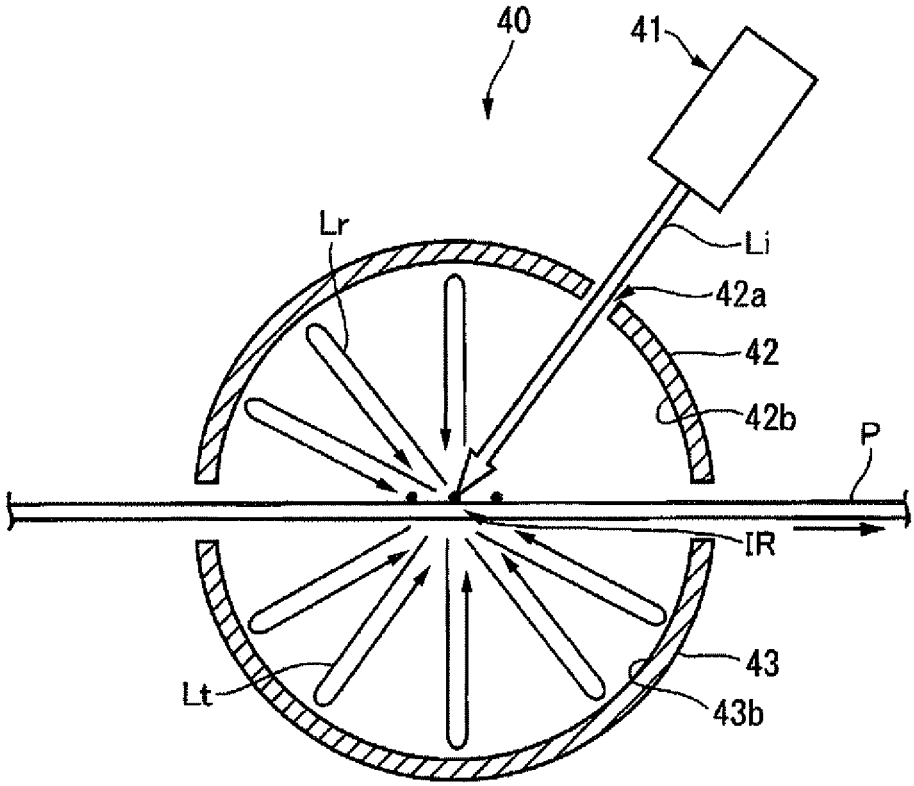
FIG. 8 is a schematic representation to show a fixing device as a second modified example of Embodiment 1 of the invention.

Further, FIG. 8 shows a second modified example of the embodiment; the position of the opening 42*a* of the reflecting member 42 differs.

In the example, the opening 42*a* of the reflecting member 42 is provided at a position to the downstream side in the conveying direction of the recording material P along the reflecting face 42*b*.

Such placement is adopted, whereby the reflected light Lr from the irradiation area IR by the laser light Li from the array laser 41 is much reflected toward the upstream side in the conveying direction of the recording material P from the opening 42*a* of the reflecting member 42. However, the wide reflecting face 42*b* exists in the part and thus the reflected light Lr is easily again applied to the irradiation area IR. Thus, the fixing efficiency is improved.

The transmitted light Lt does not increase on the upstream side as compared with the reflected light Lr and thus a difference does not much occur.

In the embodiment described above, the reflecting member 42 is of the integral type, but may be of a separate type; for example, the reflecting member may be separated in the portion of the opening 42*a*. Further, the reflection member is separated into parts in the cross-sectional direction and has a plurality of members different in the distance from the irradiation area so that the reflecting face 42*b* is separated into parts. In this case, particularly residence of air on the reflecting face 42*b* of the reflecting member 42 is suppressed, an evaporated substance from toner, etc., becomes hard to remain, and dirt occurrence on the reflecting face 42*b* is suppressed.

Similar comments also apply to the back side reflecting member 43.

In the embodiment, the array laser 41 is provided at a distant position from the recording material P as compared with the reflecting member 42. However, for example, the array laser 41 is brought close to the recording material P and may be caused to apply the laser light Li from the same position as the reflecting face 42*b* of the reflecting member 42. Further, the array laser 41 may be placed inside the reflecting member 42 (recording material P side from the reflecting face 42*b*).

In the embodiment, continuous forms paper is used as the recording material P, but cut sheets may be used. In this case, for example, a guide mechanism for guiding the recording material P toward the fixing device 40 and a conveying mechanism for conveying the recording material P may be provided separately.

In the embodiment, as the fixing device 40, after the irradiation area IR is irradiated with the laser light Li by the array laser, natural cooling is performed. However, a press member for pressing the recording material P so as to catch it in the press member may be provided downstream in the conveying direction of the recording material P in the irradiation area IR and the recording material P may be cooled in the press member. In this case, a semi-fused image heated in the irradiation area IR is pressed by the press member, whereby glossiness of the image is improved.

Further, in the embodiment, the number of irradiation areas IR is one, but a plurality of array lasers 41 may be provided relative to the conveying direction of the recording material P, for example.

Figure 9:
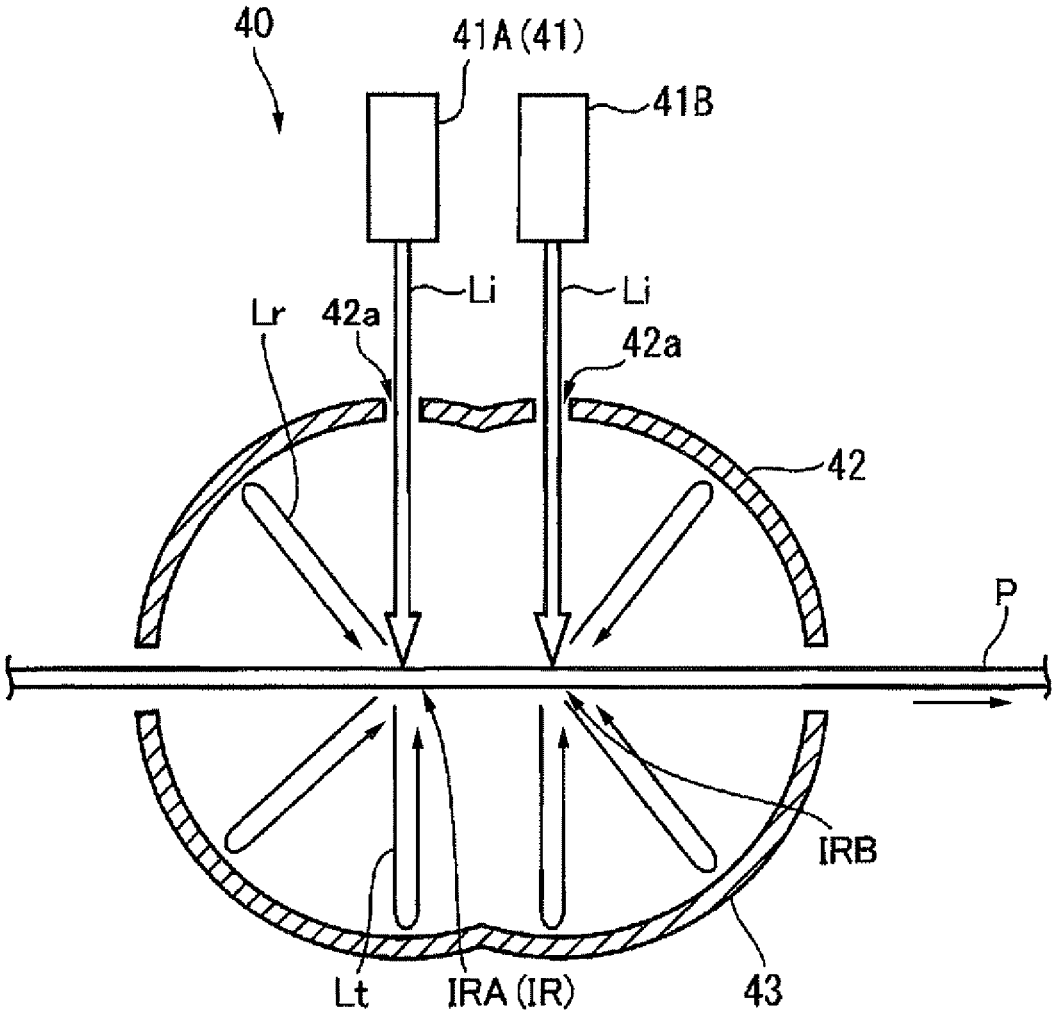
FIG. 9 is a schematic representation to show a fixing device as a third modified example of Embodiment 1 of the invention.

FIG. 9 shows a third modified example of the embodiment. One reflecting member 42 is provided with two openings 42*a* along the conveying direction of the recording material P and laser light Li beams from the two array laser 41 (41A and 41B) are applied from the openings 42*a*, whereby two irradiation areas IR (IRA and IRB) are formed.

The reflecting member 42 has two cylindrically curved surfaces arranged side by side and the back side irradiation area 43 also has a similar configuration.

In the configuration, first the laser light Li is applied to the image on the recording material P in the irradiation area IRA by the upstream array laser 41A and after a lapse of one time, further the laser light Li is applied in the irradiation area IRB by the downstream array laser 41B.

When the laser light is thus applied, the interface temperature between the toner and the recording material P a little rises in the upstream irradiation area IRA in a portion where the image density is high on the recording material P (for example, solid image portion). Then, although the interface temperature gradually falls in the portion where no laser light is applied, as the image density is high, the surface area is small, the heat discharge is small, and temperature lowering is suppressed in a small amount.

Next, heating is again performed in the downstream irradiation area IRB, whereby the interface temperature also rises sufficiently and sufficient adherence is ensured.

On the other hand, the interface temperature once rises sufficiently in the portion where the image density is low (for example, highlight image portion), but lowers rapidly. Heating is again performed in the downstream irradiation area IRB and the interface temperature again rises. That is, the interface temperature is kept by twice applying laser light in the portion where the image density is high; while, the interface temperature is kept by once applying laser light in the portion where the image density is low. This is repeated.

Therefore, sufficient adherence is ensured regardless of the image density on the recording material P.

When such two irradiation areas IR are included, the following may be performed:

Laser output in the upstream irradiation area IRA is made smaller than laser output in the downstream irradiation area IRB and accordingly the irradiation area length along the conveying direction of the recording material P is made long, whereby the irradiation time in the downstream irradiation area IRB prolongs. At this time, the irradiation strength and the irradiation area length for enabling an image to be sufficiently heated and fused in the upstream irradiation area IRA are provided conforming to the portion where the image density is high, needless to say.

When such irradiation is performed, in the portion where the image density is high, sufficient adherence is ensured in the upstream irradiation area IRA and if the downstream irradiation area IRB is irradiated with light for a short time, no problem arises. On the other hand, in the portion where the image density is low, as the contact area between the toner particles and the outside air is wide in irradiation of the upstream irradiation area IRA with light, heat discharge grows and toner is not sufficiently heated or fused. However, the irradiation strength is enhanced in the downstream irradiation area IRB and thus sufficient fusing is accomplished and adherence is ensured. This means that sufficient heating and fusing of toner are accomplished independently of the image density on the recording material P.

In the modified example, the irradiation area IR is also inclined relative to the width direction of the recording material P, needless to say.

Here, the two irradiation areas IRA and IRB are placed in parallel; if they are placed a little in unparallel, laser output can be lessened as compared with the form in which the irradiation area is provided in the width direction of the recording material P.

Exemplary Embodiment 2

Figure 10:
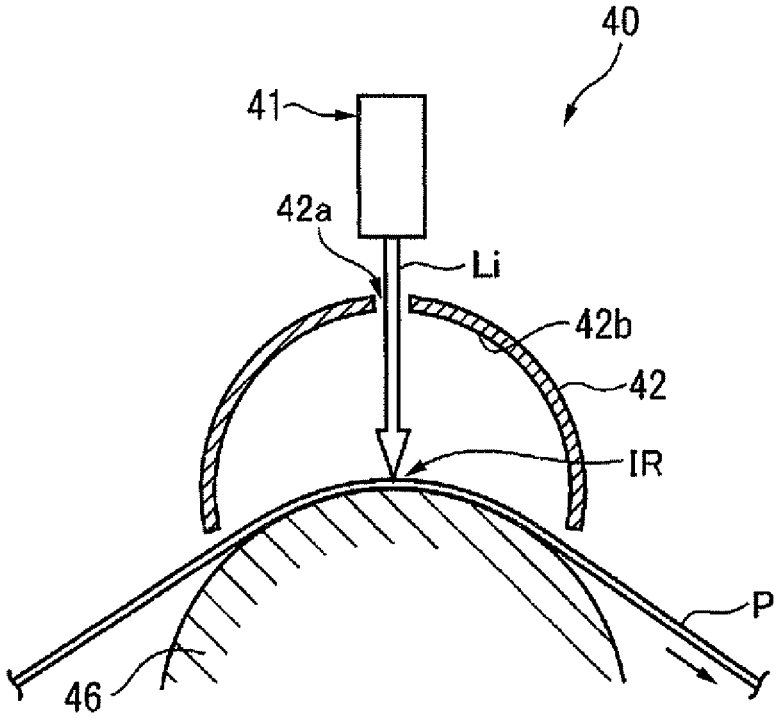
FIG. 10 is a schematic representation to show an outline of a fixing device of Embodiment 2 of the invention.

FIG. 10 is a schematic representation to show an outline of a fixing device 40 of Embodiment 2 of the invention.

The fixing device 40 of the embodiment differs from the fixing device 40 of Embodiment 1 (for example, see FIG. 5) in that it has no back side reflecting member. Components similar to those of Embodiment 1 are denoted by similar reference numerals and will not be discussed again in detail.

In the figure, the fixing device 40 has an opposed member 46 placed so as to hold a recording material P toward an array laser 41 at a position opposed to a reflecting member 42 across the recording material P. The opposed member 46 is shaped like a white and heat-resistant round bar having a surface subjected to low friction treatment using fluorocarbon resin, etc., for example, and the axial direction is placed conforming to an extension direction of an irradiation area IR. Therefore, the recording material P skewing on the opposed member 46 is conveyed more smoothly.

In the described fixing device 40, the recording material P is conveyed while always sliding on the opposed member 46, so that flopping of the recording material P in the irradiation area IR is also suppressed and laser output in the irradiation area is easily made uniformed.

Using the opposed member 46, the irradiation area IR is irradiated with laser light Li and transmitted light passing through the recording material P is reflected by the surface of the opposed member 46. Thus, if no back side reflecting member is included, reflected light from the transmitted light is again applied to the proximity of the irradiation area IR and fixing efficiency is improved.

The opposed member 46 is not limited to the round bar shape and may be shaped like a flat plate, for example, and may have a size capable of forming the irradiation area IR. The opposed member 46 may be a metal member if it has heat resistance; preferably, the opposed member 46 has small heat conductivity so as not to release heating.

Further, in the embodiment, the laser light Li is applied to the irradiation area IR from a roughly orthogonal direction, but may be applied from a slant direction, for example, as shown in FIG. 8.

Exemplary Embodiment 3

Figure 11:
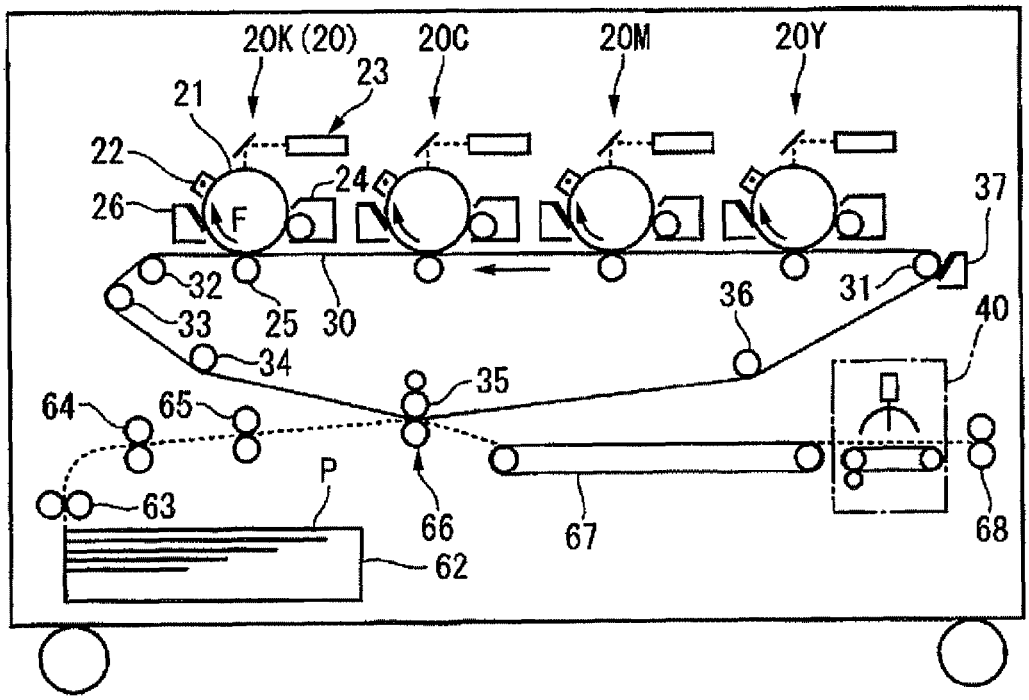
FIG. 11 is a schematic representation to show an outline of an image forming apparatus incorporating a fixing device of Embodiment 3 of the invention.

FIG. 11 shows an outline of an image forming apparatus incorporating a fixing device 40 of Embodiment 3 of the invention. The image forming apparatus of the embodiment differs from the image forming apparatus of Embodiment 1 (see FIG. 4) in that a cut recording material is used as a recording material. Components similar to those of Embodiment 1 are denoted by similar reference numerals and will not be discussed again in detail.

In the figure, the image forming apparatus uses electrophotography, for example, and is made up of color image forming sections 20 for forming multiple-color toner image using toners of four colors, for example, on a recording material (shaped like a cut sheet) P (specifically, a black image forming section 20K, a cyan image forming section 20C, a magenta image forming section 20M, and a yellow image forming section 20Y), a belt-like intermediate transfer body 30 for conveying color toner images formed in the color image forming sections 20 in a multiplex state, a batch transfer device (secondary transfer device) 66 for collectively transferring the multiplexed toner images on the intermediate transfer body 30 to the recording material P, for example, the fixing device 40 for fixing unfixed toner image transferred onto the recording material P in the secondary transfer device 66, and the like.

The color image forming sections 20 have each a roughly similar configuration except for used toner and are configured like the image forming sections 20 of Embodiment 1 (see FIG. 4) and therefore will not be discussed again in detail.

The intermediate transfer body 30 of Embodiment 3 is stretched on stretch rolls 31 to 36. For example, the stretch roll 31 is rotated as a drive roll and the stretch roll 34 is rotated as the tension roll.

The secondary transfer device 66 is placed with the stretch roll 35 as a backup roll. A belt cleaner 37 for cleaning remaining toner on the intermediate transfer body 30 is provided at a position opposed to the stretch roll 31 across the intermediate transfer body 30.

Further, a recording material storage section for storing a recording material P is provided below the intermediate transfer body 30 in the image forming apparatus. In a conveying path of the recording material P conveyed from the recording material storage section 62, a plurality of conveying rolls 63 to 65 are provided from the recording material storage section 62 to the secondary transfer device 66 and a conveying belt 67 for conveying the recording material P subjected to the secondary transfer to the fixing device 40 and a discharge roll 68 for discharging the recording material P with an image fixed by the fixing device 40 to the outside of the apparatus are provided.

Thus, in the embodiment, in each color image forming section 20, each color toner image formed on a photoconductive drum 21 rotating in an F direction in the figure is transferred onto the intermediate transfer body 30 in a transfer device (primary transfer device) 25, whereby multiplexed toner image is formed on the intermediate transfer body 30. On the other hand, the recording material P is conveyed to a secondary transfer position by the conveying rolls 63 to 65 from the recording material storage section 62 and the toner image multiplexed on the intermediate transfer body 30 is collectively transferred onto the recording material P in the secondary transfer device 66. The recording material P to which the multiplexed toner image is collectively transferred in the secondary transfer device 66 is conveyed on the conveying belt 67 and the image on the recording material P is fixed in the fixing device 40. The recording material P with the image fixed is discharged to the outside of the image forming apparatus by the discharge roll 68.

Figure 12:
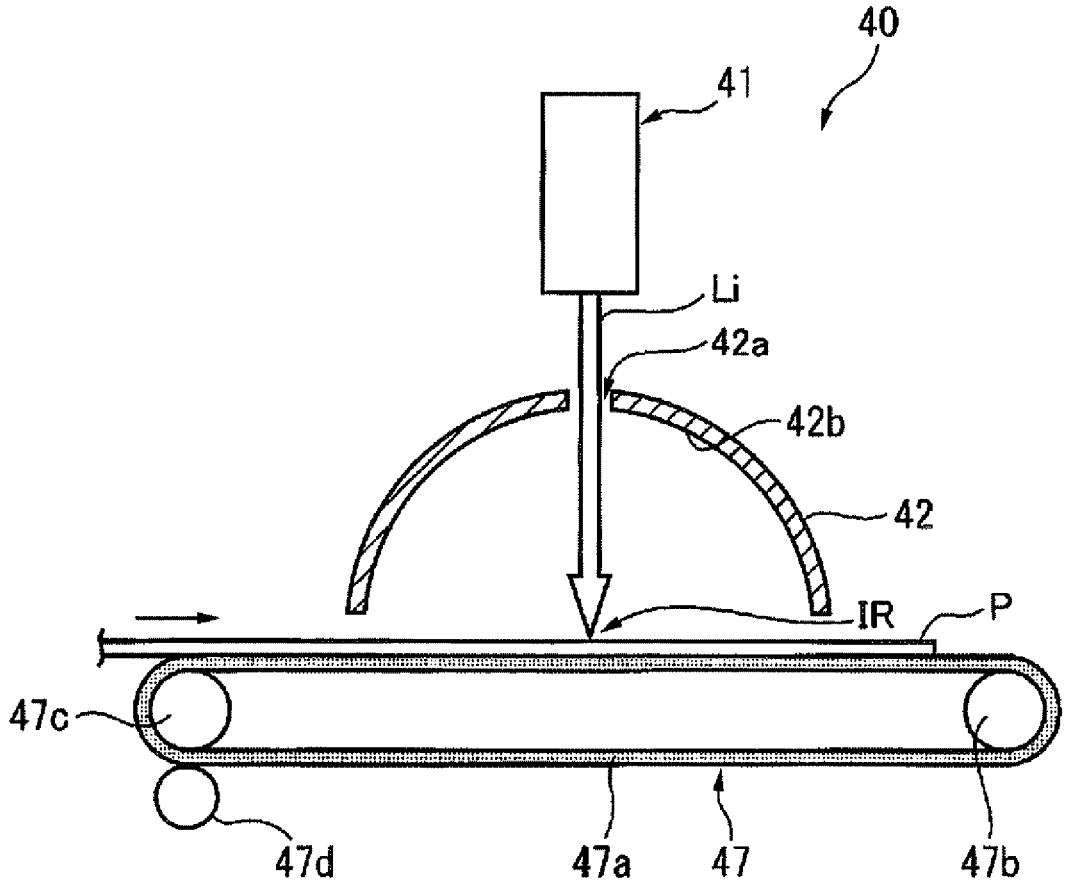
FIG. 12 is a schematic representation to show an outline of the fixing device of Embodiment 3 of the invention.

FIG. 12 shows an outline of the fixing device 40 in the embodiment. An attraction conveying device 47 of electrostatic attraction type, for example, for holding and conveying the recording material P is provided at a position opposed to the reflecting member 42 across the record sheet P.

The attraction conveying device 47 is made up of two roll members 47*b* and 47*c*, a belt member 47*a* stretched between the two roll members 47*b* and 47*c* and circulating, and a charging member 47*d* for charging the belt member 47*a*.

In the fixing device 40 of the embodiment, when the recording material P to which an unfixed toner image is transferred arrives at the fixing device 40, the belt member 47*a* of the attraction conveying device 47 is charged by the charging member 47*d* and thus the recording material P is electrostatically attracted to the belt member 47*a* and is conveyed with rotation of the belt member 47*a*. The recording material P conveyed by rotation of the belt member 47*a* is irradiated with laser light Li from an array laser 41 in an irradiation area IR and then is further conveyed downstream with rotation of the belt member 47*a*. A peeling member for easily peeling the recording material P with the image fixed from the attraction conveying device 47 is provided, whereby the recording material P is easily peeled from the belt member 47*a*. The array laser 41 and the reflecting member 42 are placed inclinedly relative to the width direction of the recording material P conveyed by the attraction conveying device 47, needless to say.

In the embodiment, the attraction conveying device 47 is used, whereby if the recording material P is a cut sheet, the attitude of the recording material P in the irradiation area IR is kept stable and the irradiation strength with the laser light Li in the irradiation area IR is also made uniform. Preferably, the belt member 47*a* used with the attraction conveying device 47 has a surface capable of reflecting transmitted light passing through the recording material P by the laser light Li in the irradiation area IR on the back side of the recording material P; for example, a white-based pigment may be added.

Here, the charging member 47*d* comes in contact with the belt member 47*a*; for example, a corona charger, etc., may be used to charge the belt member 47*a* in a distant state from the belt member 47*a*. The attraction conveying device 47 electrostatically attracts the recording material P, but the recording material P may be air-sucked from the back side of the belt member 47*a*. Further, the belt member 47*a* is stretched between the two roll members 47*b* and 47*c*; however, for example, an opposed member (for example, roll member) may be provided corresponding to the irradiation area IR and the vicinity of the irradiation area may be projected toward the array laser 41.

Exemplary Embodiment 4

Embodiment 4 of the invention differs from Embodiments 1 to 3 in that the inclination angle of an irradiation area IR relative to the width direction of a recording material in a fixing device 40 is variably adjusted. The used recording material may be continuous forms paper or a cut sheet and therefore in the description to follow, the type of recording material is not limited.

Figure 13A:
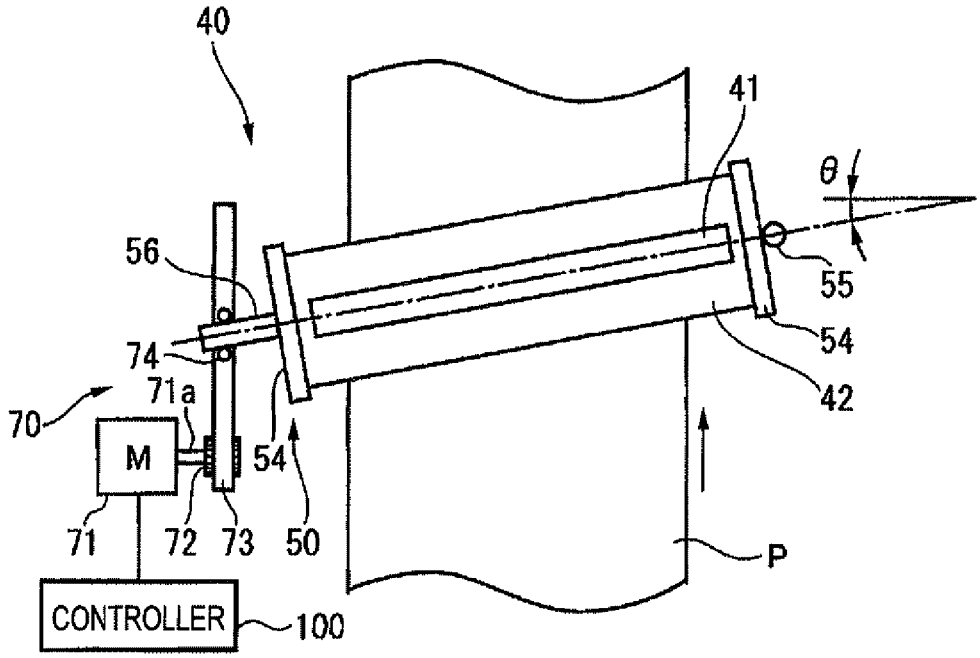
FIGS. 13A and 13B are schematic representations to show an outline of a fixing device of Embodiment 4 of the invention.
Figure 13B:
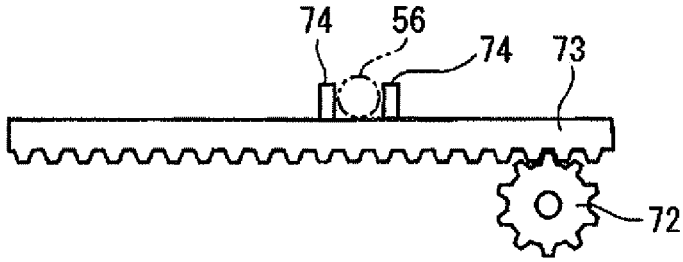

FIG. 13A shows an outline of a configuration when the fixing device 40 in the embodiment is seen from a surface of a recording material P and FIG. 13B is an enlarged view of a part of FIG. 13A.

In the figure, the fixing device 40 of the embodiment has a support mechanism 50 for supporting an array laser 41, a reflecting member 42, etc., and the array laser 41 and the reflecting member 42 are supported on subframes 54 provided in both end parts along the width direction of the recording material P. In the embodiment, a rock shaft 55 extending in a direction roughly orthogonal to the recording material face is fixedly provided on one subframe 54 and a support rod 56 extending in a direction along the recording material face is attached to the other subframe 54.

Further, in the embodiment, the fixing device has a move mechanism 70 for moving the support rod 56 along the move direction of the recording material P with the rock shaft 55 as the rock center. The move mechanism 70 bears a role of irradiation area changing unit.

The move mechanism 70 of the embodiment is made up of a motor 71, a pinion 72 rotated by a rotation shaft 71*a* of the motor, a rack 73 meshing with the pinion 72, and two guide pins 74 provided on the rack 73, and the support rod 56 on the subframe 54 side is sandwiched between the guide pins 74.

Thus, the rack 73 is moved by rotation of the motor 71, whereby inclination angle θ of the array laser 41, etc., is changed with the rock shaft 55 as the rock center. In the embodiment, a controller 100 performs change control of the inclination angle θ.

The controller 100 in the embodiment determines whether or not area coverage (image density) along the inclination angle θ exceeds a predetermined criterion value from image information of a predetermined image length in a conveying direction of the recording material P. If the area coverage exceeds the criterion value based on the determination result, the controller 100 controls the inclination angle θ so that the area coverage when new inclination angle θ is set does not exceed the criterion value.

Figure 14:
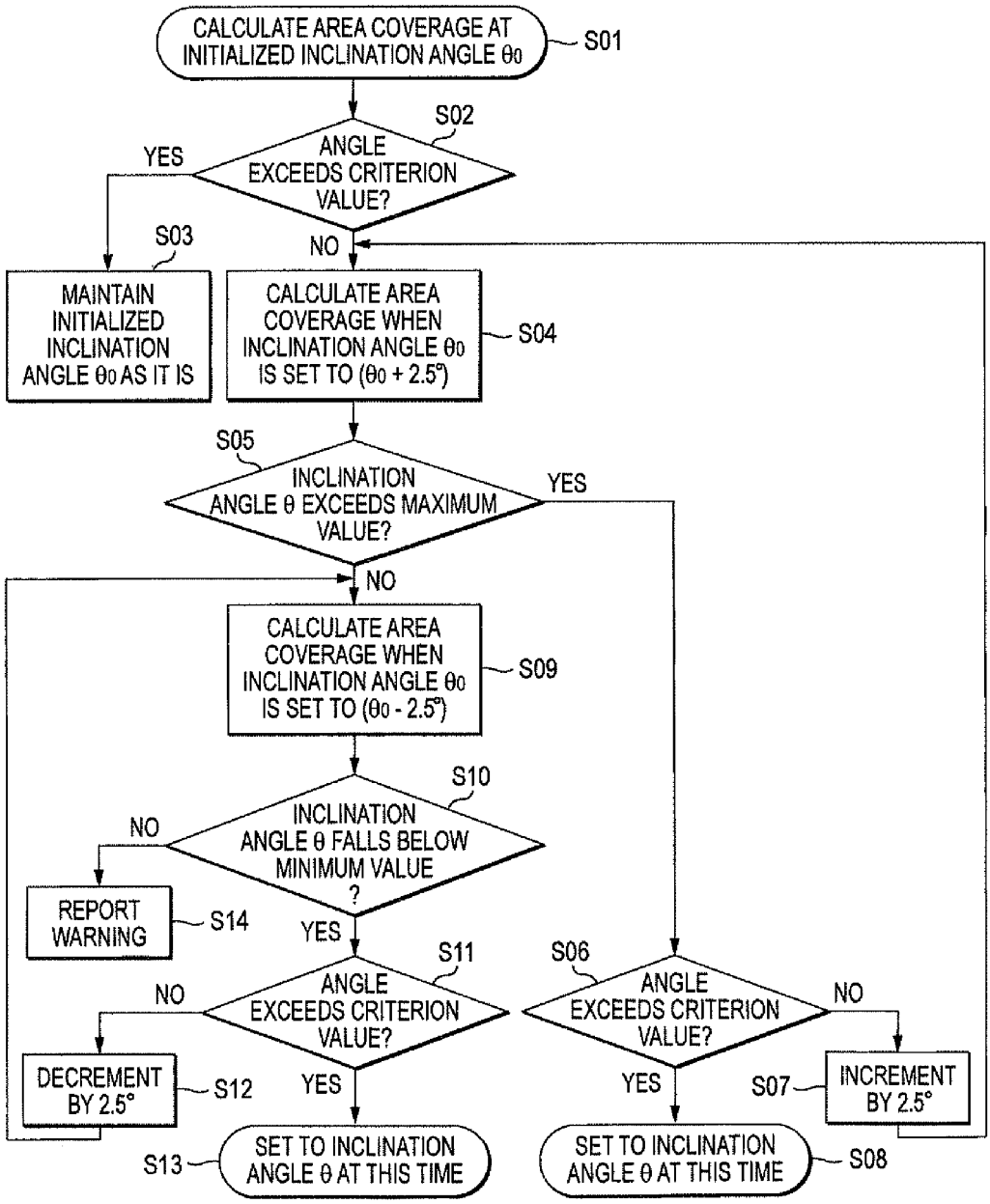
FIG. 14 is a flowchart to show a control flow of Embodiment 4 of the invention.

Thus, the controller 100 of the embodiment controls rotation of the motor 71 according to a flow shown in FIG. 14.

In the figure, first, area coverage at initialized inclination angle $\theta_0$ is calculated (S01). Whether or not the calculated value exceeds the criterion value is determined (S2). If the value does not exceed the criterion value, the initialized inclination angle $\theta_0$ is maintained as it is, and fixing is performed (S03).

If it is determined at step S02 that the calculated area coverage exceeds the criterion value, the area coverage when the inclination angle $\theta_0$ is set to ($\theta_0$+2.5°) is calculated (S04). Whether or not the inclination angle θ at this time exceeds preset maximum value is determined (S05). If the angle does not exceed the maximum value, further whether or not the angle exceeds the criterion value is determined (S06). If the angle does not exceed the criterion value, the motor 71 is rotated so that the angle is set to the inclination angle θ at this time (S08).

If the angle exceeds the criterion value, the inclination angle θ is further incremented by 2.5° (S07) and the process returns to step S04.

On the other hand, if it is determined at step S05 that the inclination angle θ exceeds the maximum value, the inclination angle θ is set to ($\theta_0$−2.5°) and new area coverage is calculated (S09). At this time, whether or not the inclination angle θ falls below the minimum value is determined (S10). If the angle does not fall below the minimum value, whether or not the area coverage exceeds the criterion value is determined (S11). If the area coverage does not exceed the criterion value, the motor 71 is rotated so that the angle is set to the inclination angle θ at this time (S13).

If it is determined at step S11 that the angle exceeds the criterion value, the inclination angle θ is further decremented by 2.5° (S12) and the process returns to step S09.

Further, if it is determined at step S10 that the inclination angle θ falls below the minimum value, it is determined that setting of the inclination angle θ is inappropriate, a warning is reported to an operator (S14).

The fixing device 40 of the embodiment calculates the state of an image in area coverage along the inclination angle θ per image, thereby stabilizing the fixing efficiency at the fixing time. Thus, the area coverage along the inclination angle θ is suppressed, the reflected light on the recording material P is effectively used, and fixing is performed efficiently.

In the embodiment, the inclination angle θ is incremented or decremented by 2.5°, but the embodiment is not limited to it; any angle may be adopted. Although the move mechanism 70 using the rack and the pinion is shown, any other known system may be applied needless to say.

Figure 15A:
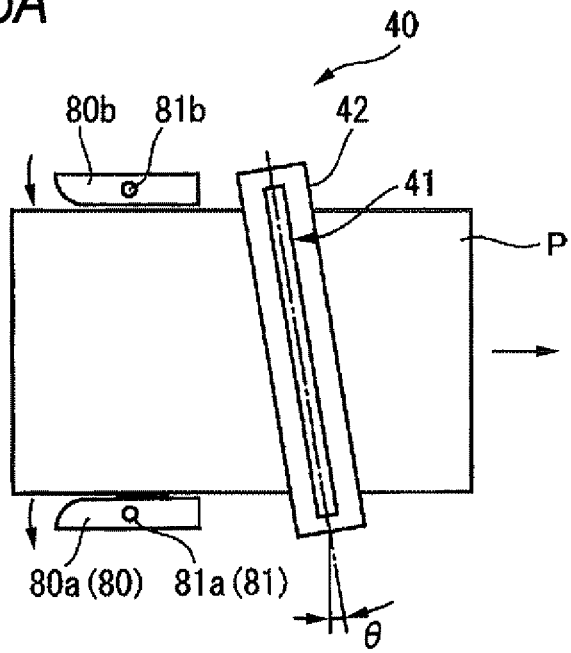
FIGS. 15A and 15B are schematic representations to show a fixing device as a modified example of Embodiment 4 of the invention.
Figure 15B:
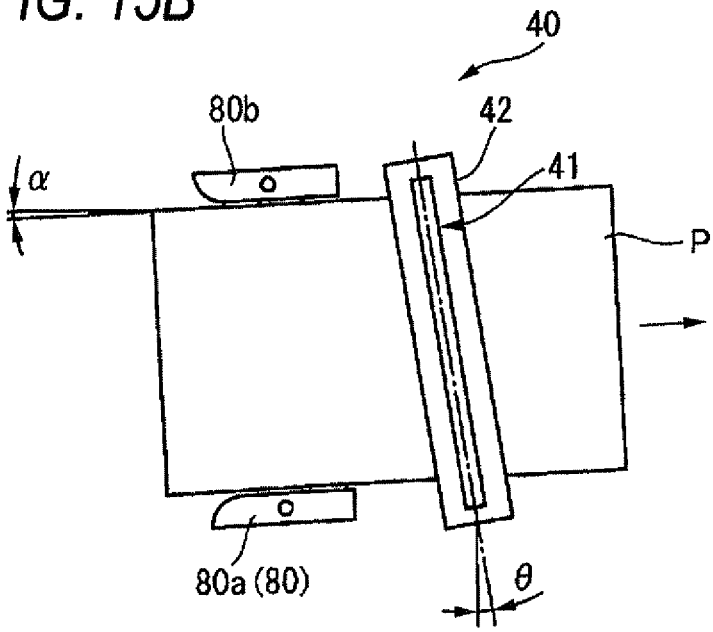

FIGS. 15A and 15B show a modified example of the embodiment. In the embodiment, the inclination angle θ on the array laser 41 side is changed; in the modified example, in a mode wherein the recording material is a cut sheet, the move direction of a recording material P is changed in response to the area coverage.

In FIG. 15A, the recording material P is conveyed while it is guided by guide members 80 (80*a* and 80*b*) for guiding the width direction of the recording material before arriving at an irradiation area. The guide members 80 have rock shafts 81 (81*a* and 81*b*) so that the guide members 80 can rock in roughly central portions, and the two guide members can rock together by a mechanism (not shown).

In the described fixing device 40, in a mode wherein an image on the recording material P is fixed at the inclination angle θ in a state in FIG. 15A, if it is determined that the area coverage exceeds a criterion value, the guide members 80 are rocked without changing the inclination angle θ, whereby the conveying direction of the recording material P is changed by angle α as in FIG. 15B and in the irradiation area with the array laser 41, the inclination angle θ from the width direction of the recording material P substantially becomes (θ−α) in the example. The conveying direction of the recording material P is thus changed, whereby it is made possible to set the area coverage to an appropriate range.

When the conveying direction of the recording material P in the fixing device 40 is thus changed, image formation is scarcely affected and therefore an obstacle does not occur.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

EXAMPLES

Example 1

In Example 1, an experiment is conducted to check the relationship between area coverage and fixing property. An array laser and a reflection member are used and an irradiation area is provided along the width direction of a recording material without inclining the irradiation area.

Figure 16:
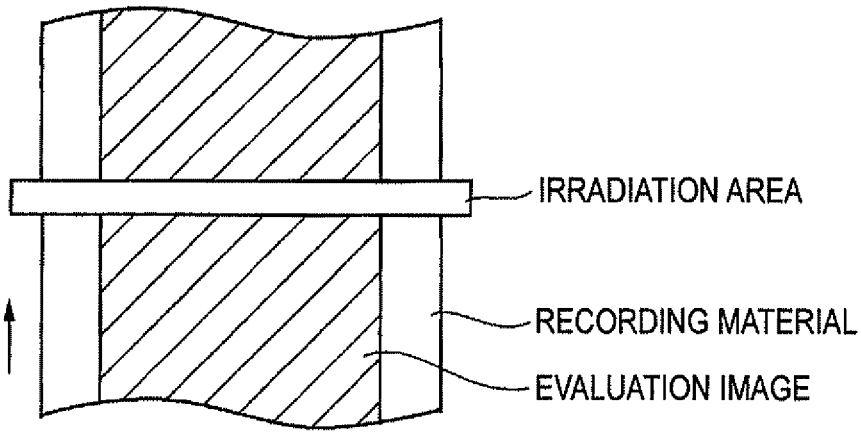
FIG. 16 is a schematic representation to show a state of an evaluation image in Example 1.

FIG. 16 shows a state of an evaluation image at the experiment time, and a 100% solid image and 60% and 20% halftone images are used.

Evaluation of the fixing property is measured according to the following index (crease value):

As the crease value in the example, a post-fixed image is once folded and is opened and a broken image portion is lightly wiped with cotton and the image width of the portion where the image is lost is evaluated in a numeric value. In the example, if the crease value is 60 or less, it is assumed that fixing has no substantial problem.

Figure 17:
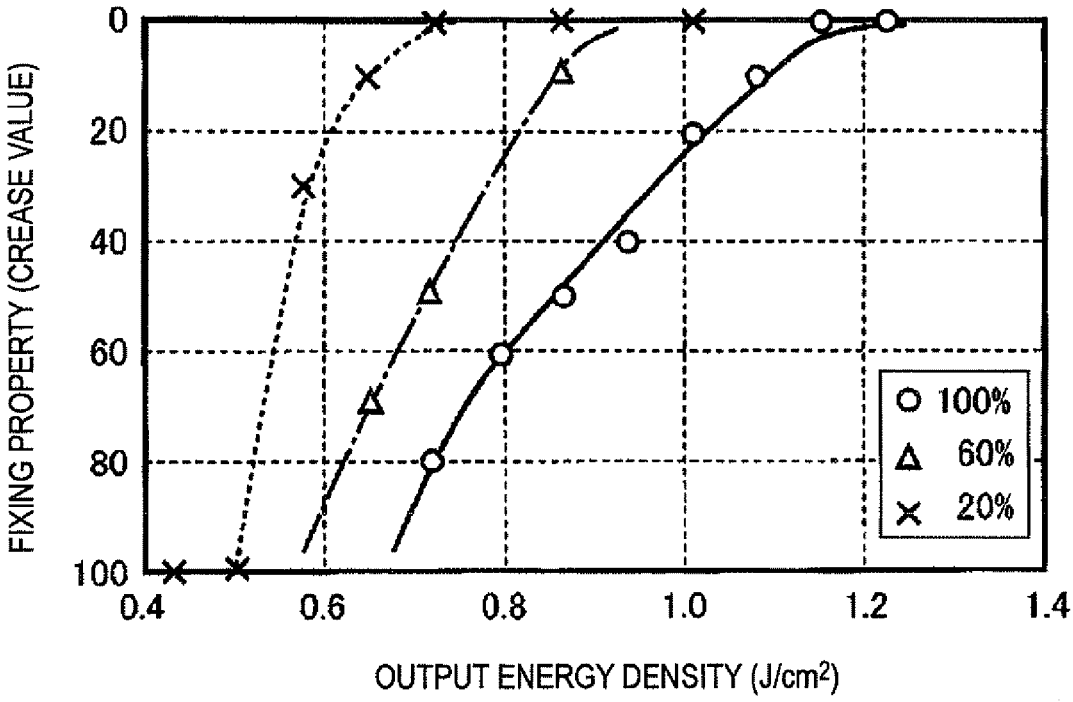
FIG. 17 is a graph to show the result of Embodiment 1.

As a result, as shown in FIG. 17, minimum necessary laser output for fixing an image (corresponding to power consumption) depends largely on the area coverage. For example, if the case where the crease value is 60 is assumed, to fix an image with area coverage about 20%, laser output of about 0.55 J/cm$^2$ is sufficient; while, laser output of 0.8 J/cm$^2$ is required for the solid image. In this case, the laser output at the fixing time must be set to 0.8 J/cm$^2$ or more and it is understood that large power is fruitlessly consumed particularly for an image with small area coverage.

Example 2

In Example 2, a fixing device has an array laser and a reflecting member (except aback side reflecting member) and area coverage when the inclination angle of an irradiation area is changed for each line image extending in the width direction of a recording material.

In the example, a beam width is set to 1.5 mm, a recording material width is set to 500 mm, and seven levels of the line width of each line image (the length along the move direction of the recording material) are selected out of the range of 1 to 50 mm.

As a result, as shown in FIG. 18, the value of the area coverage for an irradiation area rapidly lowers as the inclination angle increases; this tendency is noticeable when the line width is 10 mm or less. The irradiation area is inclined relative to the width direction of the recording material, whereby the area coverage lessens and if the line width is thick, the area coverage lessens.

In the example, when the line width is 50 mm, if the inclination angle is set to 10', the area coverage becomes 60% or less.

Referring to FIG. 17 of the result in Example 1, the following is understood: When the line width is 50 mm, if the inclination angle is set to 0°, laser output of about 0.8 J/cm$^2$ is required; if the inclination angle is set to 10°, similar fixing is performed with laser output of about 0.7 J/cm$^2$. If the line width becomes narrow, the tendency further increases; for example, when the line width is 10 mm, the inclination angle is set to about 2°, a similar effect is provided.

Further, it is also understood that, for example, when the line width is 5 mm, if the inclination angle is set to 3°, the area coverage becomes about 20% and thus laser output may be about 0.55 J/cm$^2$.

As described above, it is understood that the inclination angle in the irradiation area largely contributes to the magnitude of laser output and by extension, lower power consumption.

What is claimed is:

1. A fixing device comprising:

a conveying unit that conveys a recording material with an image formed thereon toward a predetermined conveying direction so as to cross a fixing area where the image is heated to be fixed;

a laser light source that has an irradiation area as the fixing area slantingly extending relative to a predetermined image arrangement reference direction along a width direction of the recording material crossing the conveying direction of the recording material, and irradiates the irradiation area with laser light; and a reflecting member that is provided so as to surround the irradiation area and has a reflecting face that reflects reflected light from the irradiation area so that the irradiation area is again irradiated with the reflected light.

2. The fixing device as claimed in claim 1, further comprising a back side reflecting member that is provided in a part opposed to the reflecting member across the recording material and reflects transmitted light reached from the laser light source through the recording material to be again reached to a back part of the recording material corresponding to the irradiation area.

3. The fixing device as claimed in claim 1, wherein the reflecting face of the reflecting member opposed to the recording material has a cylindrically curved surface.

4. The fixing device as claimed in claim 2, wherein the reflecting face of the reflecting member opposed to the recording material has a cylindrically curved surface.

5. The fixing device as claimed in claim 3, wherein the laser light source is provided at a position where the laser light is reached to the irradiation area from an inclined position along the cylindrically curved surface of the reflecting member from a direction orthogonal to a surface of the recording material in the irradiation area.

6. The fixing device as claimed in claim 4, wherein the laser light source is provided at a position where the laser light is reached to the irradiation area from an inclined position along the cylindrically curved surface of the reflecting member from a direction orthogonal to a surface of the recording material in the irradiation area.

7. The fixing device as claimed in claim 1, further comprising a protection member that allows the laser light to pass through and prevents a substance evaporated from the image on the recording material from being deposited on the reflecting face of the reflecting member.

8. The fixing device as claimed in claim 2, further comprising a protection member that allows the laser light to pass through and prevents a substance evaporated from the image on the recording material from being deposited on the reflecting face of the reflecting member.

9. The fixing device as claimed in claim 3, further comprising a protection member that allows the laser light to pass through and prevents a substance evaporated from the image on the recording material from being deposited on the reflecting face of the reflecting member.

10. The fixing device as claimed in claim 4, further comprising a protection member that allows the laser light to pass through and prevents a substance evaporated from the image on the recording material from being deposited on the reflecting face of the reflecting member.

11. The fixing device as claimed in claim 5, further comprising a protection member that allows the laser light to pass through and prevents a substance evaporated from the image on the recording material from being deposited on the reflecting face of the reflecting member.

12. The fixing device as claimed in claim 6, further comprising a protection member that allows the laser light to pass through and prevents a substance evaporated from the image on the recording material from being deposited on the reflecting face of the reflecting member.

13. The fixing device as claimed in claim 1, further comprising:

a determination unit that determines whether or not an image density along an extending direction of the irradiation area exceeds a predetermined criterion value from image information of a predetermined image length in the conveying direction of the recording material; and an irradiation area changing unit that, in case the image density exceeds the criterion value based on the determination result of the determination unit, finds an extending direction of a new irradiation area wherein an image density in a slanting direction relative to the width direction of the recording material and a different direction from the extending direction of the irradiation area does not exceed the criterion value, and changes the irradiation area so that the irradiation area becomes the new irradiation area.

14. The fixing device as claimed in claim 2, further comprising:

a determination unit that determines whether or not an image density along an extending direction of the irradiation area exceeds a predetermined criterion value from image information of a predetermined image length in the conveying direction of the recording material; and an irradiation area changing unit that, in case the image density exceeds the criterion value based on the determination result of the determination unit, finds an extending direction of a new irradiation area wherein an image density in a slanting direction relative to the width direction of the recording material and a different direction from the extending direction of the irradiation area does not exceed the criterion value, and changes the irradiation area so that the irradiation area becomes the new irradiation area.

15. The fixing device as claimed in claim 3, further comprising:

a determination unit that determines whether or not an image density along an extending direction of the irradiation area exceeds a predetermined criterion value from image information of a predetermined image length in the conveying direction of the recording material; and an irradiation area changing unit that, in case the image density exceeds the criterion value based on the determination result of the determination unit, finds an extending direction of a new irradiation area wherein an image density in a slanting direction relative to the width direction of the recording material and a different direction from the extending direction of the irradiation area does not exceed the criterion value, and changes the irradiation area so that the irradiation area becomes the new irradiation area.

16. The fixing device as claimed in claim 4, further comprising:

a determination unit that determines whether or not an image density along an extending direction of the irradiation area exceeds a predetermined criterion value from image information of a predetermined image length in the conveying direction of the recording material; and an irradiation area changing unit that, in case the image density exceeds the criterion value based on the determination result of the determination unit, finds an extending direction of a new irradiation area wherein an image density in a slanting direction relative to the width direction of the recording material and a different direction from the extending direction of the irradiation area does not exceed the criterion value, and changes the irradiation area so that the irradiation area becomes the new irradiation area.

17. The fixing device as claimed in claim 5, further comprising:

a determination unit that determines whether or not an image density along an extending direction of the irradiation area exceeds a predetermined criterion value from image information of a predetermined image length in the conveying direction of the recording material; and an irradiation area changing unit that, in case the image density exceeds the criterion value based on the determination result of the determination unit, finds an extending direction of a new irradiation area wherein an image density in a slanting direction relative to the width direction of the recording material and a different direction from the extending direction of the irradiation area does not exceed the criterion value, and changes the irradiation area so that the irradiation area becomes the new irradiation area.

18. The fixing device as claimed in claim 6, further comprising:

a determination unit that determines whether or not an image density along an extending direction of the irradiation area exceeds a predetermined criterion value from image information of a predetermined image length in the conveying direction of the recording material; and an irradiation area changing unit that, in case the image density exceeds the criterion value based on the determination result of the determination unit, finds an extending direction of a new irradiation area wherein an image density in a slanting direction relative to the width direction of the recording material and a different direction from the extending direction of the irradiation area does not exceed the criterion value, and changes the irradiation area so that the irradiation area becomes the new irradiation area.

19. An image forming apparatus comprising:

an image forming section that forms an image on a recording material; and the fixing device as claimed in claim 1 that fixes the image formed on the recording material in the image forming section.

20. The image forming apparatus as claimed in claim 19, wherein the recording material is provided to be continuous along the conveying direction.

21. The fixing device as claimed in claim 1, wherein the irradiation area slantingly extends so as to utilize reflected light from a portion of a non-image area.

* * * * *